United States Patent [19]

Whitling

[11] 4,218,056

[45] Aug. 19, 1980

[54] RESTRAINT PARTICULARLY SUITED FOR USE AS AN AQUATIC TRAINING AID

[76] Inventor: Tom S. Whitling, 5023 E. Tulare, Fresno, Calif. 93727

[21] Appl. No.: 954,564

[22] Filed: Oct. 25, 1978

[51] Int. Cl.[2] ..... A63B 69/14

[52] U.S. Cl. ..... 272/71; 35/29 B; 73/379; 272/DIG. 5

[58] Field of Search ..... 272/71, 94; 35/29 B, 35/29 E, 29 R; 9/310 J, 311, 348, 400, 301, 303; 73/379, 381

[56] References Cited

U.S. PATENT DOCUMENTS

| | | | |
|---|---|---|---|
| 2,049,434 | 8/1936 | Erickson | 272/94 X |
| 2,680,967 | 6/1954 | Newman | 73/379 |
| 3,140,550 | 7/1964 | Wayfield | 35/29 B |
| 3,362,090 | 1/1968 | Adam | 128/25 R X |
| 3,512,416 | 5/1970 | Howart | 272/71 X |
| 3,521,622 | 7/1970 | Collins, Jr. | 35/29 R X |
| 3,538,911 | 11/1970 | Emmons | 35/29 R X |
| 3,605,144 | 9/1971 | Hayte | 272/94 X |
| 3,724,012 | 4/1973 | Sanderson | 272/71 |

*Primary Examiner*—Richard C. Pinkham
*Assistant Examiner*—Arnold W. Kramer
*Attorney, Agent, or Firm*—Huebner & Worrel

[57] ABSTRACT

A restraint, particularly suited for use in exercising swimmers, characterized by a base adapted to be affixed to a wall of a water-filled pool, a socket of a truncated helmet-like configuration adapted to receive a swimmer's head, coupling means including a universal joint connecting the socket to the base supporting the socket for universal oscillation, and a pair of handles suspended to be grasped by the swimmer. Where so desired, pressure sensing means are interposed between the base and the socket for measuring pressures at which the swimmer's head is applied to the socket and, where further desired, guides of substantially elongated configurations are suspended from the base in substantially spaced parallelism beneath the surface plane of the water and employed in controlling stroking motion of the swimmer.

10 Claims, 7 Drawing Figures

FIG. 1
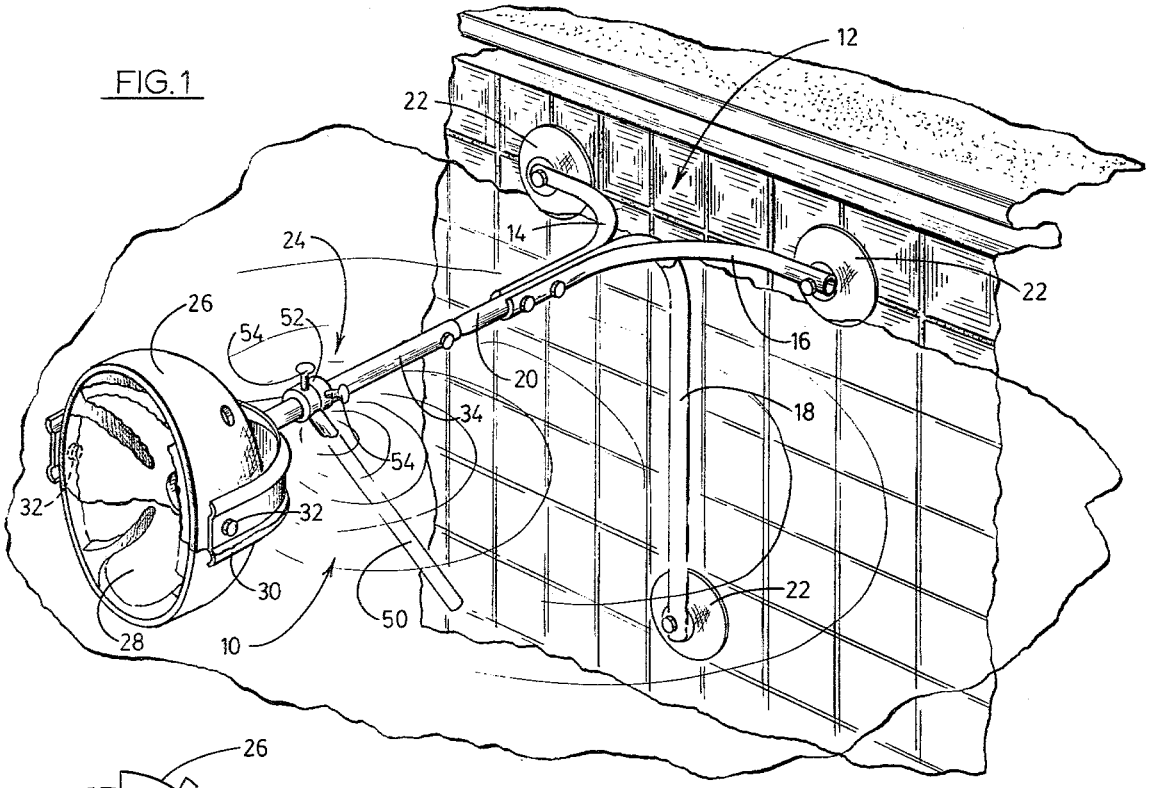
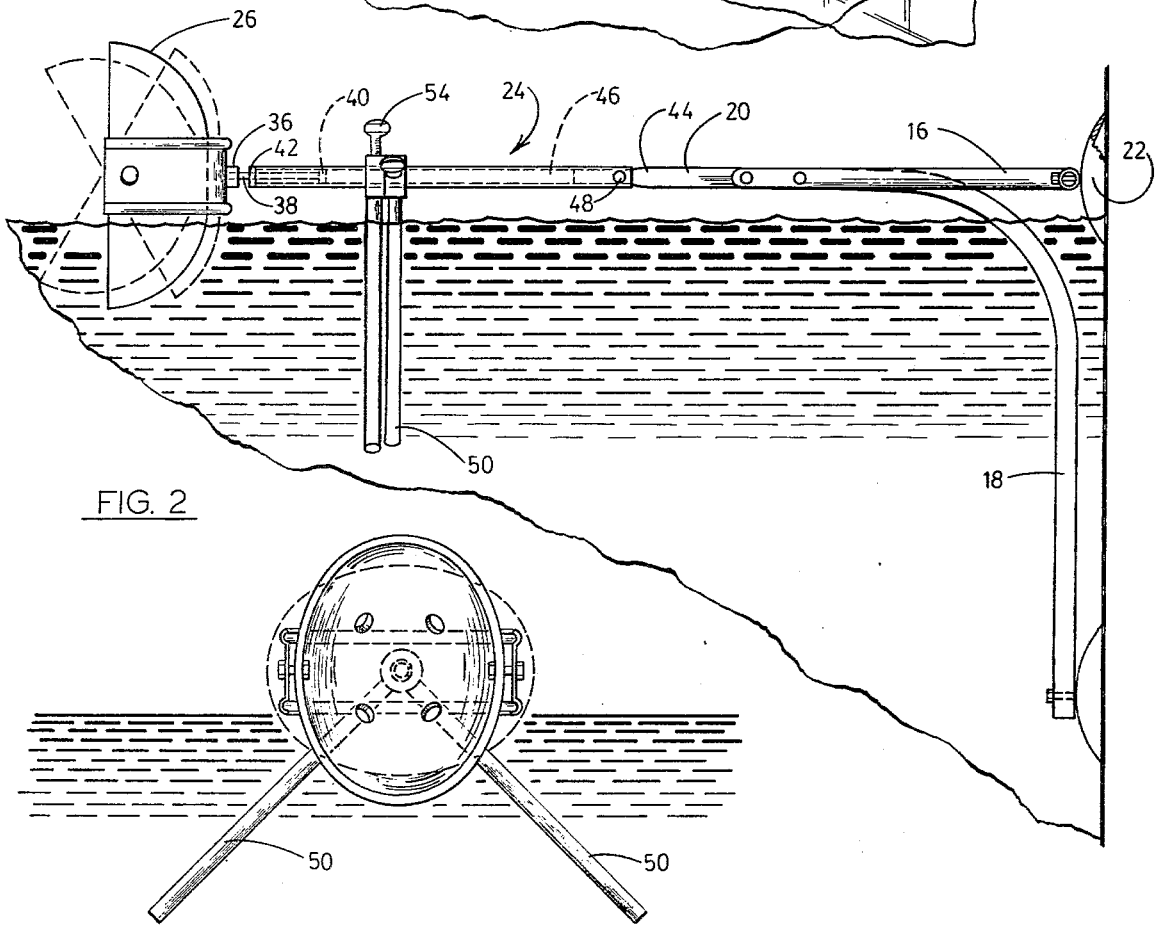
FIG. 2
FIG. 3

RESTRAINT PARTICULARLY SUITED FOR USE AS AN AQUATIC TRAINING AID

BACKGROUND OF THE INVENTION

1. Field of the Invention

The invention generally relates to aquatic training devices and more particularly to a restraint adapted to be readily affixed to a pool wall and employed by swimmers as a training aid.

2. Description of the Prior Art

The prior art is, of course, replete with restraints, weights and the like employed in developing competitive swimmers. Frequently, devices such as harnesses anchored to springs and/or weights are attached to swimmers in training and employed as aids in developing the swimmer. Additionally, so-called dry-land exercises often are utilized with a view to muscular development of swimmers. These exercises frequently include a use of weights and the like. However, it is generally accepted, particularly among swimmers and their coaches, that distance work-outs in pools of suitable dimensions for training competitive swimmers are greatly preferred over the currently employed techniques which make use of harnesses, weights, dry-land exercises and so forth.

As can be appreciated by those familiar with the art of teaching competitive swimming, often pools of adequate sizes are not readily available for training purposes, particularly at lower amateur levels. As a consequence, swimmers often are required to train in pools of dimensions considered to be less than adequate for achieving desired development of muscular tone and/or stroke technique.

It is, therefore, the general purpose of the instant invention to provide a device adapted to function as a restraint particularly suited for use as an aquatic training aid in the training of swimmers, including swimmers engaged in recreational and therapeutic exercises, as well as those engaged in competitive swimming programs.

OBJECTS AND SUMMARY OF THE INVENTION

It is an object of the instant invention to provide a restraint particularly suited for use as an aquatic training aid.

It is another object to provide a device for use in developing both recreational and competitive swimmers.

It is another object of the instant invention to provide a device particularly suited for use as an exercising aid for swimmers.

It is another object to provide a device for receiving the head of a swimmer in a manner such that uninterrupted stroking and/or kicking is facilitated in a pool area of relatively small dimensions.

It is another object to provide a device through a use of which the force output of a swimmer's stroke and/or kick readily can be determined.

It is another object to provide a device particularly suited for use as an aquatic training aid for swimmers exercising in a pool of dimensions substantially less than the dimensions of a pool usually considered adequate for suitably accommodating training of competitive swimmers; characterized by arm guides through a use of which stroke technique is taught, and a pressure sensing device through a use of which the power output of a swimmer readily can be measured.

These and other objects and advantages are achieved through the use of a device which includes a base of a substantially tripodal configuration, including legs characterized by terminal suction feet adapted to attach the base to a substantially vertical wall of a water-filled pool, a socket of a truncated helmet-like configuration adapted to receive a swimmer's head applied thereto with sufficient pressure for maintaining therebetween a mated relationship, coupling means including a universal joint connecting the socket to the base and supporting the socket for simultaneous oscillation about a pair of normally related horizontally disposed axes, as will become more readily apparent by reference to the following description and claims in light of the accompanying drawings.

DESCRIPTION OF THE DRAWINGS

FIG. 1 is a fragmented perspective view of a device embodying the principles of the instant invention.

FIG. 2 is a side elevational view of the device.

FIG. 3 is an end elevational view of the device.

DESCRIPTION OF THE PREFERRED EMBODIMENT

Figure 4:
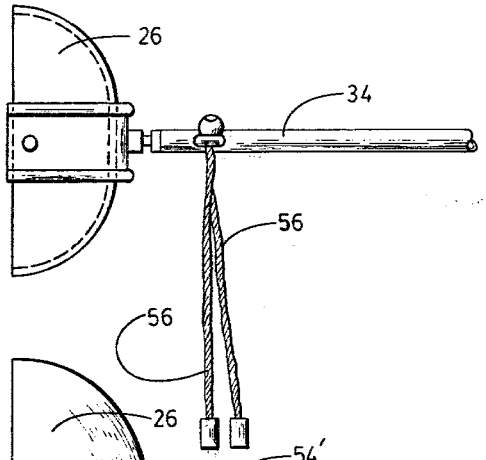
FIG. 4 is a side elevational view of a modified form of the device.

Referring now to the drawings with more particularity, wherein like reference characters designate like or corresponding parts throughout the several views, there is shown in FIG. 1 a device, generally designated 10, which embodies the principles of the instant invention.

As shown in the drawings, the device 10 includes a pedestal, generally designated 12, comprising a base of a substantially tripodal configuration. The pedestal 12, as shown, includes legs 14, 16 and 18 substantially extended at right angles from a stem 20. The legs 14 and 16 are of a substantially common length and are adapted to be arranged in substantially horizontal coaxial alignment with the leg 18 normally related thereto. As a practical matter, the length of the leg 18 exceeds the length of the legs 14 and 16 for purposes of providing an increased moment about an axis substantially extended through the coaxially aligned portions of the legs 14 and 16. Each of the legs 14 through 18 is provided with a foot comprising a so-called suction cup 22 of conventional construction. Each of the cups 22 serves to mount one of the legs on a vertical surface of a pool wall, filled with a body of water. Since suction cups and their operation are well known, and the details thereof form no part of the claimed invention, a detailed description of the suction cups 22 is omitted in the interest of brevity. However, it is to be understood that the cups 22 are adapted to adhere to the face of a pool wall, such as the pool wall shown in FIG. 1, and serves to support the device 10 in an operative disposition within the pool defined by the pool wall to which the device is attached.

To the pedestal 12 there is attached a pillar 24 the purpose of which is to support a socket 26 for receiving the head of a swimmer, preferably in a prone or swimming position. It is noted that the socket 26, as shown, comprises a truncated helmet including suitable padding 28. Of course, the socket 26 may be of any design and configuration suitable for receiving the head of a swimmer in a manner such that the swimmer's head is restrained against forward motion toward the pool wall as the swimmer continues stroking.

The socket 26 is mounted in a U-shaped cradle 30 employing pins 32 which function as trunions and to connect the socket 26 with the cradle. It should now be apparent that the socket 26 is supported by pins 32 for oscillation about an axis extended through both of the legs of the cradle.

The cradle 30, in turn, is connected with the stem 20 through the use of a tubular body 34 mounted on and affixed to stem 20. The cradle 30 is connected to the body 34 by a pivotal coupling 36 through which the cradle 30 is afforded oscillation about an axis normally related to the axis extended through the legs of the cradle. While the pivotal coupling 36 is of any suitable design, as shown, the coupling includes a bearing pin 38 extended axially into the body 34 having its extended end seated against a shoulder 40 arranged internally of the body in a manner such that axial displacement of the pin 38 relative to the body is precluded. Preferably, an annular bearing 42 is mounted at the end portion of the body 34 in circumscribing relation with the pin 38 and serves to support the pin for rotation about an axis coincident with the longitudinal axis of symmetry for the body 34. Thus the socket 26 is afforded omnidirectional oscillatory motion for accommodating the motion of a swimmer's head during stroking exercises.

The particular manner in which the support body 34 is affixed to the stem 20 is varied as desired. However, where so desired, the adjacent end portion, designated 44, of the stem 20 is so configured as to be received by the adjacent end portion of the body 34 within a tubular opening 46 axially extended into the body 34. In such instances, a coupling pin 48 is inserted through coaxially aligned bores, not designated, provided in mated portions of the stem 20 and body 34.

As illustrated in FIGS. 1, 2 and 3, downwardly diverging handles 50 of a rigid construction are attached to the support body 34 for purposes of affording a swimmer an opportunity to support himself in a suitable position relative to the socket 26. As shown, each of the handles 50 includes an annular base 52 through which is extended the body 34 and is secured at a desired angle of inclination employing a set screw 54. It should be apparent that the handles 50 may be adjustably positioned relative to a horizontal plane simply by loosening the set screws 54, repositioning the handles, and thereafter again tightening the set screws.

Referring for a moment to FIG. 4, it can be seen that where so desired handles 50 may be replaced by a pair of depending thongs 56. Of course, when the thongs 56 are employed, in lieu of the handles 50, the device 10 is in operation subjected to less torque and pressure.

Figure 5:
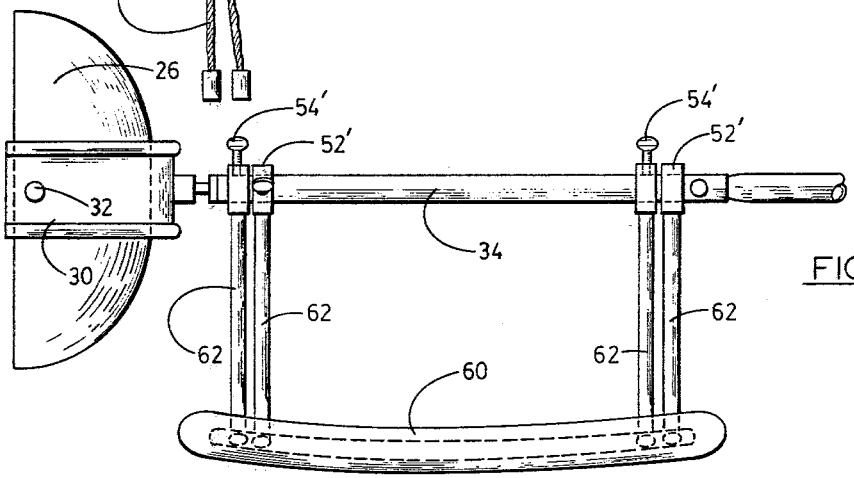
FIG. 5 is a side elevational view of a modified form of the device.
Figure 6:
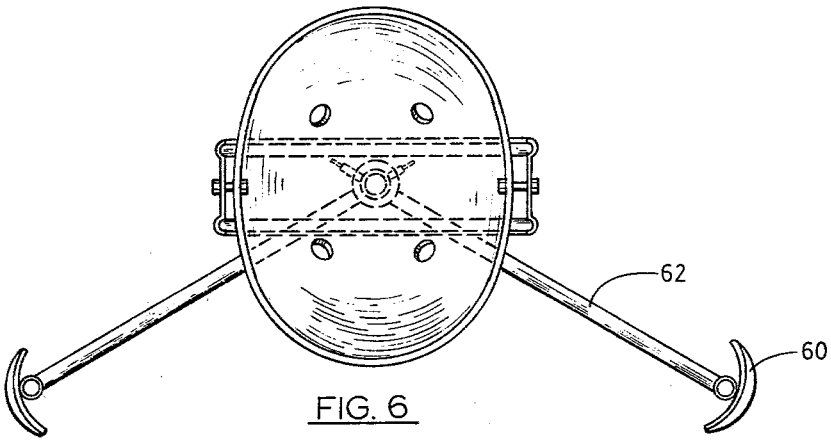
FIG. 6 is a front elevational view of the device shown in FIG. 5.

Referring now to FIGS. 5 and 6, it can be seen that, where so desired, the handles are removed and arm guides, designated 60, are mounted on the support body 34. Each of the arm guides 60 is supported by a pair of depending arms 62 mounted in axially spaced relation employing an annular base 52' similar in design and function to the annular base 52. Each base 52' is secured in place through the use of a set screw 54', also similar in design and function to the set screws 54. The purpose of the arm guides 60, generally, is to assure a swimmer that his arms do not close prior to passing shoulder level as the swimmer practices stroke techniques and/or is engaged in muscle building exercises. Due to the adjustability of the base 52' for each of the arms 62 adjustment of the spacing between the guides 60 readily is accommodated.

Figure 7:
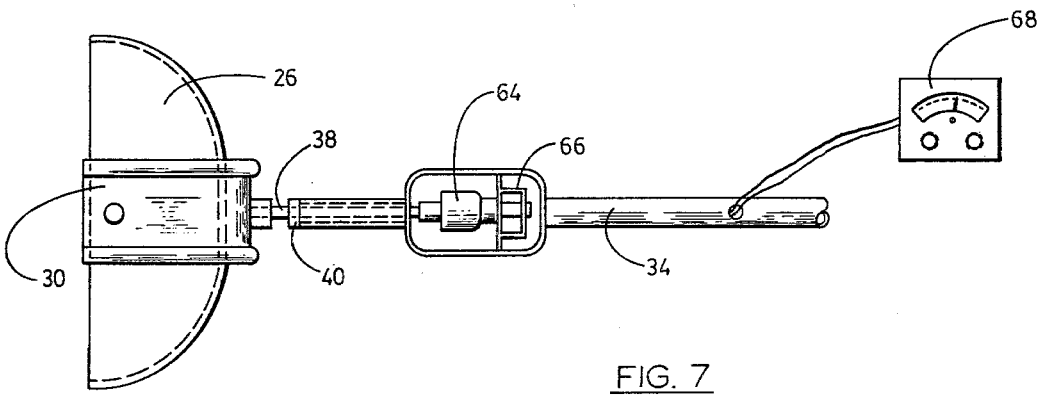
FIG. 7 is a fragmented side elevational view of still another modified form of the device illustrating pressure sensing means for measuring the force output of a swimmer's stroke.

With reference to FIG. 7, it is noted that where so desired, a pressure measuring device or transducer 64 is interposed between the pin 38 and a bracket 66 rigidly mounted on the body 34. The purpose of the transducer 64 is to provide an output signal to a suitable meter 68 which, in effect, provides an indication of pressure axially applied to the pin 38 by a swimmer having his head seated in the socket 26. While the transducer 64 may be of any suitable design, as shown, the transducer comprises a commercially available strain gauge which varies the electrical output thereof in response to changes in pressure applied thereto. Preferably, the transducer 64 is connected to the pin 38 in a manner such that pressure axially applied to the pin 38 varies the electrical output obtained therefrom and applied to a suitable meter 68 via leads, not designated. It is to be understood that the details of the pressure measuring device 64 and meter 68 form no part of the claimed invention. Therefore, a detailed description of the transducer and meter is omitted in the interest of brevity. It should now be apparent that through a use of the transducer 64 it is possible to determine precisely the magnitude of the force of a swimmer's stroke.

OPERATION

It is believed that in view of the foregoing description, the operation of the invention herein disclosed is apparent. However, in the interest of completeness the operation of the disclosed invention will, at this point, be reviewed.

With the device assembled in the manner illustrated in FIGS. 1, 2 and 3, the device 10 is affixed to a vertical wall of a pool containing therein a body of water, simply by applying suction cups 22 to the surface of the wall.

The pedestal 12 is attached to the wall with the base stem 20 extended near the surface plane of the body of water confined within the pool, as best illustrated in FIG. 2. Of course, the particular spatial relationship between the stem 20 and the surface plane of the pool is varied as desired, depending upon the swimmer, his technique and/or stroke to be practiced or exercise to be performed.

With the head portion 24 attached to the stem 20 and the handles 50 suitably positioned and secured in place through a tightening of the set screws 54 the device 10 is readied for operation.

A swimmer simply swims to the device and places his head in the socket 26 and begins stroking. Where the handles are positioned for affording balance and/or assuring the swimmer's head remains inserted into the socket 26, the swimmer may grasp the handles for assuring that his head remains mated with the socket 26. In any event, so long as the swimmer's head remains mated with the socket 26, the device 10 prevents the swimmer from advancing toward the wall, even while stroking with full force.

In some instances, it may be found desirable to eliminate the handles 50 and, in lieu thereof, employ thongs, designated 56, which function in a manner similar to the handles 50. However, it can be appreciated that the thongs 56 are less likely to afford a high degree of balance but, in practice, the thongs tend to reduce application of excessive torque to the body 34.

In instances where it becomes desirable to assure that a swimmer does not reach directly above his head in the performance of a swimming stroke, the arm guides 60 are employed. The arm guides 60 simply provide a surface along which the swimmer's arms may slide as he brings his arms back toward his body in the completion of a stroke.

In instances where a pressure measuring device, such as the transducer 64, is employed pressure applied axially to the pin 38 by a swimmer results in an electrical output signal being applied to the meter 68. Where so desired, a recording pen may be attached to the meter for permanently recording the force dictated by the pressure measuring device 64.

In view of the foregoing, it is believed to be readily apparent that the device embodying the principles of the instant invention provides a practical solution to many problems heretofore plaguing those engaged in the arts of teaching swimming, both for competitive and recreational purposes. However, it is to be understood that the utility of the device is in no way limited to use as a training aid for teaching swimmers, but can be employed equally as well in a wide range of activities performed in an aquatic environment.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A device particularly suited for use as an aquatic training aid comprising:

A. a rigid base adapted to be affixed to a wall defining a pool and project therefrom along an axis lying in a plane substantially paralleling the surface plane of a body of water confined within the pool;

B. a socket adapted to receive in mated relation the head of a user applied therewith pressure sufficient to maintain said mated relation; and C. coupling means interconnecting said socket with said base including an elongated body interposed between the base and the socket, and means mounting said socket on said elongated body for oscillation of said socket with respect to said elongated body about a pair of normally related axes.

2. A device as defined in claim 1 further comprising a pair of arm guides of elongated configurations arranged in substantial parallelism suspended from said elongated body and adapted to be disposed beneath said surface plane and employed in controlling stroking motion for said user.

3. A device as defined in claim 1 further comprising a pressure sensing means for measuring pressures at which the user's head is applied to said socket.

4. A device as defined in claim 1 further comprising handles suspended from said elongated body adapted to be grasped by said user.

5. A device as defined in claim 4 wherein said handles comprise a pair of rigid handle bars.

6. A device as defined in claim 4 wherein said handles comprise a pair of thongs depending from said elongated body.

7. A device as defined in claim 1 further including pressure sensing means interposed between said base and said socket for measuring pressures at which the head of user is applied to said socket.

8. A restraint particularly suited for use as an aquatic training aid for swimmers in a pool of dimensions substantially less than the dimensions of a pool usually considered adequate for suitably accommodating training of competitive swimmers, comprising in combination:

A. a pedestal of a substantial tripodal configuration including suction feet adapted to affix the pedestal to a substantially vertical wall of a water-filled pool;

B. a head socket of a truncated helmet-like configuration adapted to receive a swimmer's head applied thereto with sufficient pressure for maintaining therebetween a mated relationship;

C. means comprising a universal joint connecting said socket to said pedestal and supporting the socket for simultaneous oscillation about a pair of normally related substantially horizontally disposed axes with the socket being faced outwardly from said pool wall, whereby the head of the swimmer may remain mated with the socket so long as the swimmer remains substantially prone in the water; and D. pressure sensing means interposed between the pedestal and said socket for measuring pressures at which the swimmer's head is applied to said socket.

9. A restraint as defined in claim 8 further comprising arm guides of substantially elongated configurations suspended from said pedestal in substantially spaced parallelism adapted to be disposed beneath the surface plane of a body of water confined within said pool and project outwardly from the wall thereof.

10. A restraint as defined in claim 8 further comprising a pair of handles suspended from said pedestal in a position to be grasped by the swimmer as the swimmer's head is received by said socket.

* * * * *